United States Patent [19]

Kamiyama et al.

[11] Patent Number: 4,473,052

[45] Date of Patent: Sep. 25, 1984

[54] FULL OPEN THROTTLE CONTROL FOR INTERNAL COMBUSTION ENGINE

[75] Inventors: Shuichi Kamiyama, Tokyo; Takashi Ishida, Ohimachi, both of Japan

[73] Assignee: Mikuni Kogyo Kabushiki Kaisha, Tokyo, Japan

[21] Appl. No.: 498,182

[22] Filed: May 25, 1983

[51] Int. Cl.[3] ..... F02M 31/00

[52] U.S. Cl. ..... 123/478; 123/480

[58] Field of Search ..... 123/478, 350, 399, 480, 123/486, 491, 436, 454, 483, 359, 360, 361, 483

[56] References Cited

U.S. PATENT DOCUMENTS

| | | | |
|---|---|---|---|
| 3,575,147 | 4/1971 | Harrison et al. | 123/483 |
| 3,916,854 | 11/1975 | Barton et al. | 123/360 |
| 4,155,332 | 5/1979 | Yaoyoshi et al. | 123/478 |
| 4,205,377 | 5/1980 | Oyama et al. | 123/480 |
| 4,391,254 | 7/1983 | Staerzl | 123/478 |
| 4,418,673 | 12/1983 | Tominari et al. | 123/478 |
| 4,424,785 | 1/1984 | Ishida et al. | 123/478 |

*Primary Examiner*—Raymond A. Nelli
*Attorney, Agent, or Firm*—Owen, Wickersham & Erickson

[57] ABSTRACT

Maintaining maximum power at wide-open throttle in a fuel injection type of internal combustion engine having a computer receiving input from (1) an accelerator pedal, (2) a pressure-drop sensor across the air intake-throttle, and (3) an engine-speed sensor, the computer producing output controlling an actuator that controls the position of the throttle and controlling a valve that controls the instantaneous amount of fuel being injected. The movement of the throttle towards its wide-open position is stopped just before it reaches that position where an accurate reading of pressure drop across the throttle can be and is being obtained. Substantially instantaneously, the airflow and proper air-fuel flow ratio are calculated for the stopped position while the throttle movement is checked. From these calculated amounts and the known relationship of the stoped position to the wide-open position, the computer then calculates what the airflow will be at the wide-open throttle position and then determines what the fuel flow should be, given the stored and desired air-fuel ratio. Then the throttle is advanced to its wide-open position, while simultaneously, the computer acts on the basis of the calculated airflow and fuel flow for the wide-open position to generate the flow relationship of fuel and air for the engine.

8 Claims, 2 Drawing Figures

FULL OPEN THROTTLE CONTROL FOR INTERNAL COMBUSTION ENGINE

FIELD OF THE INVENTION

This invention relates to an electronically controlled fuel system for an internal combustion engine and more particularly to one capable of operating efficiently in the full or wide-open throttle mode.

BACKGROUND OF THE INVENTION

In a fuel injection system, (unlike a carburetor controlled system) the fuel delivery system and the air delivery system of an internal combustion engine are separated. As a result, explicit devices must be provided to determine how much fuel to deliver and to provide the actuating and regulating mechanism to deliver it. Since the amount of fuel needed by an engine depends on the amount of air being used (or vice-versa), any fuel-injected engine needs some form of measurement of the actual airflow through the engine.

Thus, in copending application Ser. No. 228,973, filed Jan. 27, 1981, which is assigned to the assignee of this application, an electronically controlled fuel injection system for a spark ignition internal combustion engine is disclosed wherein airflow rate is controlled automatically to provide a proper ratio with the fuel flow rate established by an operator, as by depression of an accelerator pedal. A computer is utilized to calculate the optimum airflow rate using the fuel flow command input and various correction information derived from certain engine parameters. The calculated airflow rate is applied by controlling the angular position of a rotatable throttle plate within an air passage to the engine.

In some other fuel injection systems, the fuel flow rate is similarly determined from an airflow command input.

In the operation of a vehicle, it may be necessary or desirable at times to operate it with a full or wide-open throttle. With fuel injection engines of either type described, this presents some problems.

The two most common means of measuring the engine's airflow in fuel injected engines are a flow meter in series with the inlet air and a hot-wire meter similarly placed. Since there is always some pressure drop across the meter, the maximum power of the engine is diminished at wide-open throttle by the presence of either type of meter.

This diminution in engine power is due to a type of "insertion loss", due to the fact that the act of making the measurement also affects the system being measured.

In an attempt to minimize insertion loss, many fuel injected systems measure airflow indirectly by measuring the pressure drop across the throttle, or by measuring the absolute pressure in the intake manifold. In systems that derive the airflow measurement from the pressure drop across the throttle, that pressure drop becomes nearly zero when the throttle goes to wide open, and the measurement of airflow by the pressure drop becomes meaningless, because the signal available is smaller than the precision limit of the instrument. This type of measurement therefore threatens the loss of engine control, and in fuel injected systems wherein the amount of fuel to be injected is calculated from airflow, airflow measurement is required for the controller to know how much fuel to give the engine. Accurate airflow measurement at wide-open throttle is just as vital in systems controlling airflow relative to fuel flow.

There are several possible strategies for overcoming this problem. One would be to use the engine speed to predict the amount of air the engine will use. However, this approach is generally impractical because there are significant differences in volumetric efficiency among engines as manufactured. Also, as engines age, their volumetric efficiency changes, and thus, the prediction may not be as good as is necessary for desired engine performance. Another possible solution is to prevent the throttle from opening beyond that point at which sufficient precision is still available in the measurement of pressure drop to give a meaningful airflow measurement. But when the throttle is never able to reach its widest opening, the maximum power available from the engine is reduced.

It is, therefore, a general object of the present invention to solve the aforesaid problems and to provide a method for operating a fuel injection internal combustion engine automatically and efficiently with the proper air-fuel ratio at the wide-open throttle position.

Another object of the invention is to provide such a method for wide-open throttle operation of a fuel injected engine that enables maximum power to be attained and avoids the necessity of relying on a priori engine performance data.

Still another object of the invention is to provide a system for enabling wide-open throttle operation of a fuel-injected engine that uses a controllable throttle actuated by signals from an electronic computer within the system.

SUMMARY OF THE INVENTION

The present invention utilizes a computer-controlled throttle, unlike the current production systems on which the driver directly controls the throttle position with the accelerator pedal. The computer-controlled throttle is used, whether the engine control is accomplished on the basis of the airflow dictating the fuel flow or vice versa.

In accordance with the invention, a control system for an internal combustion engine is provided which comprises a computer that receives fuel command signals related to the position of an accelerator pedal which is pressed by the operator of the engine or vehicle. Within an air conduit to the engine is a rotatable throttle plate connected to an actuator and thereby movable to determine the volume of air to the engine. Mounted within the conduit is one or more fuel injection devices controlled by the computer output. A pair of pressure sensors located upstream and downstream from the throttle plate or a differential type pressure sensor to measure the pressure difference between the upstream and downstream of the throttle plate provide input signals to the computer, which in turn controls the throttle actuator.

In accordance with the invention, a "calibration" of the engine behavior is accomplished in response to the driver's request for maximum power from the engine. The throttle plate is rotated by its actuator towards its full open position, but instead of going to maximum power immediately, there is a momentary stop at a nearly wide-open position.

While at this intermediate throttle position, airflow measurements are made to calibrate the current engine volumetric efficiency. Using the data so obtained, the fuel flow for full-open throttle can be calculated accurately, regardless of engine aging or other reasons for changes in engine operating parameters.

The reason that this invention needs a computer-controlled throttle is that in systems with driver control of the throttle, it is not possible to stop the throttle at the intermediate, nearly open position for calibration. In terms of the measurement theory issue of "insertion loss", this method substantially limits the insertion loss only to the very short period of time necessary to do the calibration.

DESCRIPTION OF A PREFERRED EMBODIMENT

Figure 1:
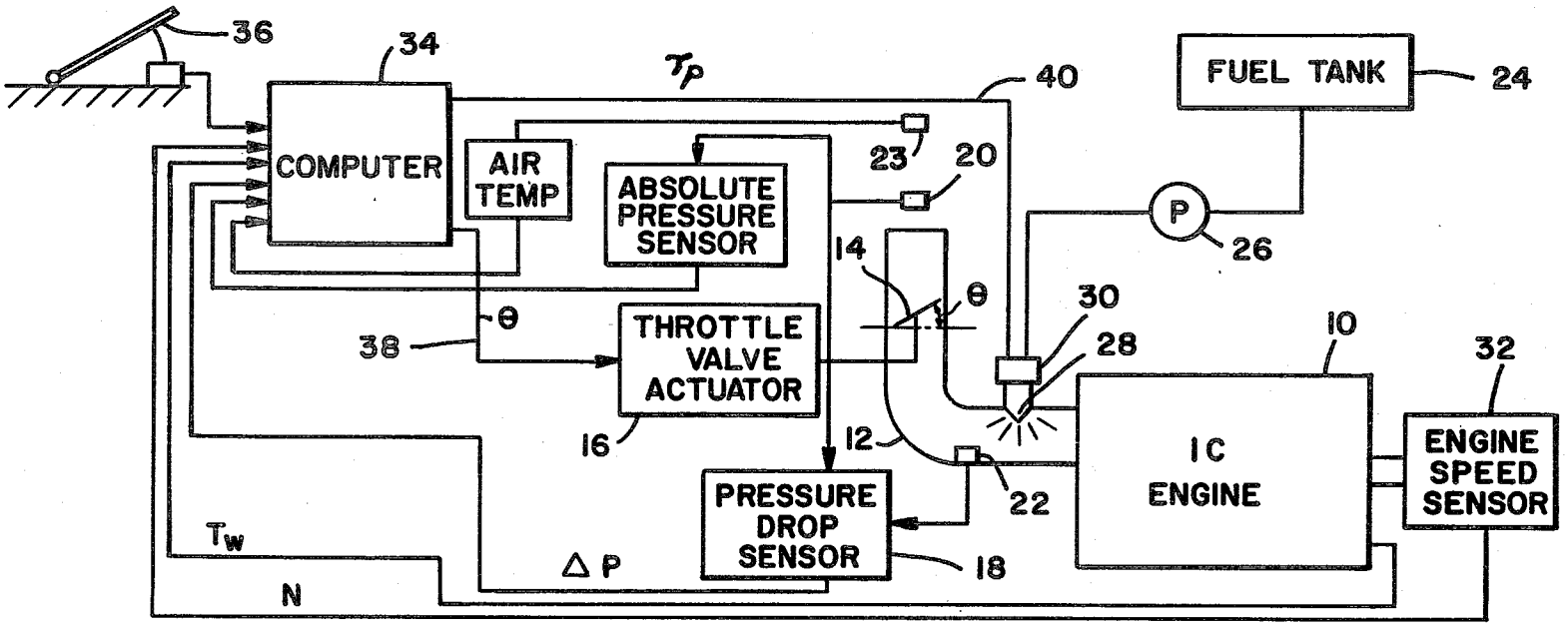
FIG. 1 is a block diagram of an internal combustion engine employing fuel injection and embodying the principles of the invention.

In FIG. 1, an internal combustion engine 10 is provided with an air-intake manifold 12 having a throttle valve 14 of the butterfly type. The position of the throttle valve 14 is governed by a throttle valve actuator 16. A pressure-drop sensor 18 includes a sensor member 20 on the air inlet side of the valve 14 and a sensor member 22 on the engine side of the valve 14.

Fuel is fed from a tank 24 by a pump 26 to an injector nozzle 28 having a valve or other flow control device 30. The engine 10 has an engine speed sensor 32.

Signals from the sensors 18, 22, and 32 are fed to a computer 34, which also receives a signal from an accelerator pedal 36, controlled by the foot of the driver of the vehicle. the computer 34, after suitable calculations, sends a signal by a lead 38 to the throttle valve actuator 16 and a signal by a lead 40 to the injector valve 30.

The position of the accelerator pedal 36 is a command which may be interpreted by the computer 34 either as the desired fuel flow rate, the desired airflow rate, or the desired engine speed, depending on which the manufacturer chooses, the computer 34 being programmed accordingly. The computer 34 calculates a required fuel flow rate QF and airflow rate QA to meet the command. The computer 34 finds an injector pulse width $\tau_p$, based on the fuel flow rate QF and the engine rpm N, delivered to the computer 34 from the engine speed sensor 32. The pulse width $\tau_p$ is then given to the injector valve 30. Based on the airflow rate QA and the measured pressure drop $\Delta P$ across the throttle valve 14, the computer 34 finds a desired throttle angle $\theta$, and sends it by the lead 38 to the throttle actuator 16 which sets the throttle angle to the desired value of $\theta$.

Figure 2:
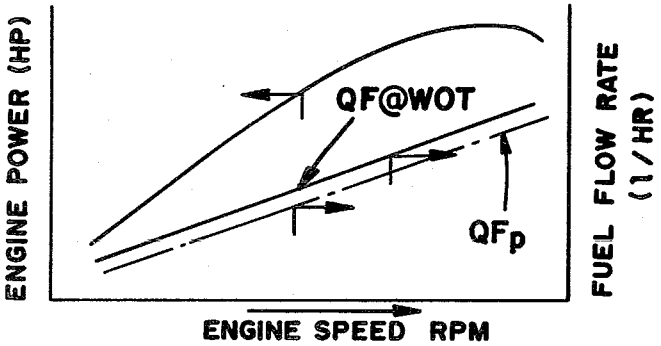
FIG.2 is a graph showing typical wide-open throttle characteristics of an internal combustion engine.

The wide-open throttle control system works in the following way: The signal from the accelerator pedal 36 is translated into a command fuel flow rate $QF_D$. The computer 34 compares this commanded fuel flow rate $QF_D$, that is, the rate commanded by the position of the accelerator pedal, with a prescribed fuel limiting value $QF_P$, which a predetermined value stored in the computer. The value $QF_P$ is proportional to the engine speed N and is an estimate of the actual fuel flow rate near the wide-open position of the throttle 14. An example plot of $QF_P$ (in liters (1)/hr) vs. engine speed (in rpm) is shown in FIG. 2 (dashed line). Note that the $QF_P$ curve lies slightly below the full open or wide-open throttle (WOT) fuel flow line. FIG. 2 also shows an engine power curve, showing that power can decrease once a certain engine speed is reached.

When the commanded fuel flow rate $QF_D$ exceeds the fuel limiting value ($QF_P$), the computer sets the fuel flow rate to $QF_P$. The computer then uses the desired air/fuel ratio at the limit point, ($AF_P$) to find the airflow at the limiting point, ($QA_P$) by the formula:

$$QA_P = AF_P \times QF_P.$$

The computer uses the airflow at limit, ($QA_P$) to adjust the throttle 14. The nature of the values $QF_P$ and $AF_P$ is such that the manifold pressure $P_{mp}$ is sufficient to measure with the desired precision. The desired airflow $QA_P$ is held constant over a certain time duration so that the actual airflow rate QA and the manifold pressure, $P_{mp}$ are allowed to stabilize.

Assuming that there are no changes in the engine volumetric efficiency and in the engine speed, the airflow rate $QA_{WL}$ at wide-open throttle, is predicted by the computer to be:

$$QA_{WL} = \frac{P_A}{P_{mp}} \times QA_P \tag{1}$$

where $P_A$ is the absolute pressure at the throttle intake point 20, FIG. 1, and $P_{mp}$ is the manifold absolute pressure at point 22, FIG. 1.

In equation (1) and hereafter, the subscript "L" refers to quantities which are used to predict the engine conditions at wide-open throttle and result from measurements made during the time that the throttle is momentarily stopped short of wide-open throttle.

Notice that when the throttle 14 is wide open, the throttle intake presure $P_A$ is essentially the same as the manifold pressure $P_{mp}$. Based on (1), the fuel flow rate at the wide-open throttle, $QF_L$, is predicted by:

$$QF_{WL} = QA_{WL}/AF_{WL} = \frac{P_A}{P_{mp}} \times QA_P/AF_{WL} = \frac{P_A}{P_{mp}} \times \frac{AF_P}{AF_{WL}} \times QF_P \tag{2}$$

where: $AF_{WL}$ is the desired air-fuel ratio $$\left(\frac{QA_{WL}}{QF_{WL}}\right)$$

at the time of the momentary stop; and $AF_P = QA_P/QF_P$.

The air-fuel ratio at the wide-open throttle $AF_W$ is determined by the computer 34 and it depends on the engine speed and the water temperature ($t_w$).

The fuel flow rate prediction (2) must be further corrected for engine speed variation. The throttle intake pressure $P_{AL}$ and the engine speed $N_L$ are stored at the moment the prediction of fuel flow rate is made (by Equation (2)). After computing $QF_{WL}$, the computer 34 sends the throttle valve actuator 16 a command value of angle $\theta$ to open the throttle 14 fully.

Based on $QF_{WL}$, the earlier predicted fuel flow rate at wide-open throttle, the corrected fuel flow rate corresponding to the wide-open throttle, $QF_W$ is:

$$QF_W = QF_{WL} \times \frac{N}{N_L} \times \frac{\eta}{\eta_L} \times \frac{P_A}{P_{AL}} \times \frac{AF_{WL}}{AF_W} \times \frac{T_{AL}}{T_A} \tag{3}$$

where:

N is the current (wide-open throttle) engine speed, $N_L$ is the engine speed at the time this mode was entered.

$\eta$ is the estimated or preprogrammed volumetric efficiency at the current wide-open throttle engine speed, $\eta_L$ is the estimated or preprogrammed volumetric efficiency which was stored at the time this wide-open throttle mode was entered (the time of prediction).

$P_A$ is the present absolute air pressure at point 20, FIG. 1, $P_{AL}$ is the absolute air pressure at point 20, FIG. 1, at the time this mode was entered (the time at which Equation (2) was predicted).

$AF_W$ is the value of the air fuel ratio used at the wide-open throttle engine condition. This value, $AF_W$, may be a function of N or water temperature or one or more other variables. $T_{AL}$ is the air temperature at point 23, FIG. 1, which was measured and stored at the time this mode was entered. $T_A$ is the present engine intake air temperature measured at this same point 23.

While in the wide-open throttle control mode, the computer 34 calculates the airflow below which we must return to the normal (not wide-open throttle) mode. $QA_R$, the airflow rate, and $QF_R$, the fuel flow rate, to make the transition from the wide-open throttle control to normal control may be defined as follows:

$$QA_R = QA_W \times \frac{P_A - \Delta P_R}{P_A} \quad (4)$$

$$QF_R = QF_W \times \frac{P_A - \Delta P_R}{P_A} \quad (5)$$

$\Delta P_R$ is the manifold pressure value which is large enough to measure and thereby allow the determination of the airflow rate QA.

When the condition $Qf_D < QF_R$ is detected, the throttle 14 is moved toward the closing direction until the measured differential pressure reaches $\Delta P_R$.

The foregoing principles of the present invention can be demonstrated by the following example, using typical values that may be provided by an internal combustion engine operating at the wide-open throttle condition. The following three sets of values represent engine Modes A (Normal Cruise); B (a short time lag after the driver's movement of the accelerator pedal, which creates a demand exceeding the fuel flow limit, ($QF_P$) thereby causing a prediction procedure; C (the actual wide-open throttle condition) and D (the transition back to normal (below $QF_P$ fuel flow) operation):

Mode A, Normal Cruise:

$A/F = 14.5$ $N = 1500$ RPM $\theta = 20°$ $\Delta P = 400$ mm Hg $QF = 1$ gram/sec $QFP = 1.2$ gram/sec Mode B, At Prediction:

$QFD = 8$ gram/sec tis
$\Delta P = 50$ mm Hg $A/F = 14.5$ $N = 1700$ RPM $\theta = 70°$ $QF = 2.5$ gram/sec $QFP = 2.5$ gram/sec Mode C, at WOT:

$QFD = 8$ grams/sec $\Delta P = 0$ mm Hg $A/F = 12.5$ $N = 3500$ RPM $\theta = 90°$ $QF = 7.5$ gram/sec Mode D, Transition back to Normal (below $QF_P$) Operation:

$QFD = 5$ gram/sec $\Delta P = 50$ mm Hg $A/F = 14.5$ $N = 2800$ RPM $\theta = 80°$ $QF = 5$ gram/sec $QFP = 5.5$ gram/sec In Mode A, the values shown are typical for a vehicle under normal cruising conditions. In Mode B, the driver has actuated the accelerator pedal, thereby causing a demand signal for a large amount of fuel, greater than $QF_P$. This triggers the prediction procedure as described earlier, in accordance with the equations (2) and (3), the computer determines the fuel flow rate at wide-open throttle $QF_W$ which will achieve the desired air fuel ratio $Af_W$ at wide-open throttle. In returning from the wide-open throttle condition (Mode D), the driver allows the accelerator pedal to return to a lesser position which reduces the required fuel flow. At some point, the required air flow will be less than $QA_R$, as shown in equation (4), the value below which, the transition must be made to normal control. When this level is reached, the computer closes the throttle to a point at which a measurable pressure is sensed, and accordingly, the fuel flow is now in the normal range (below $QF_P$), even though the engine is operating at a higher RPM.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A method for maintaining maximum power at wide-open throttle in a fuel injection type of internal combustion engine having a computer receiving input from (1) an accelerator pedal, (2) a pressure-drop sensor means across the air intake throttle, (3) an engine-speed sensor, said computer producing output controlling an actuator that controls the position of the throttle and controlling a valve that controls the instantaneous amount of fuel being injected, comprising:

stopping the movement of the throttle towards its wide-open position just before it reaches that position and while an accurate reading of pressure drop across the throttle can be and is being obtained;

substantially instantaneously calculating the airflow and proper air-fuel ratio for the stopped position while the throttle movement is checked;

calculating from these calculated amounts and the known relationship of the stopped position to the wide-open position, what the airflow and proper air-fuel ratios for the wide-open throttle position should be; and then advancing the throttle to its wide-open position and simultaneously causing the computer to act on the basis of the calculated airflow and air-fuel ratio for the wide-open position to generate the flow relationship of fuel and air for the engine.

2. The method of claim 1 wherein said computer also receives inputs from (4) an absolute pressure sensor, and (5) an air temperature sensor, and including the step of using the absolute air pressure and air temperature inputs to more accurately calculate the fuel flow at the wide-open throttle condition which will yield the desired air-fuel ratio at wide-open throttle.

3. A method for maintaining maximum power at wide-open throttle in a fuel injection type of internal combustion engine having a computer receiving input from (1) an accelerator pedal, (2) a pressure-drop sensor across the air intake throttle, (3) an engine-speed sensor, (4) an absolute pressure sensor, and (5) an air temperature sensor, said computer producing output controlling an actuator that controls the position of the throttle and controlling a valve that controls the instantaneous amount of fuel being injected, comprising:

stopping the movement of the throttle towards its wide-open position at a locus just before it reaches that position where an accurate reading of pressure drop across the throttle can be and is being obtained, said locus having a known relation to said wide-open positions;

substantially instantaneously calculating the airflow and proper air-fuel ratio for the stopped position while the throttle movement is checked;

calculating, from these calculated amounts and said known relationship, what the airflow and proper air-fuel ratios for the wide-open throttle position would be; and then advancing the throttle to its wide-open position and simultaneously causing the computer to act on the basis of the calculated airflow and air-fuel ratio for the wide-open position and to generate the flow relationship of fuel and air for the engine.

4. The method of claim 3 wherein the fuel flow rate $QF_W$ is calculated according to the equation:

$$QF_W = QF_{WL} \times \frac{N}{N_L} \times \frac{\eta}{\eta_L} \times \frac{P_A}{P_{AL}} \times \frac{AF_{WL}}{AF_W} \times \frac{T_{AL}}{T_A}$$

where:

N is the current (wide-open throttle condition) engine speed, $N_L$ is the engine speed when the throttle is at the stopped position, $\eta$ is the preprogramed volumetric efficiency at the wide-open throttle condition, $\eta_L$ is the preprogramed volumetric efficiency when the throttle is at the stopped position, $P_A$ is the current (wide-open throttle condition) absolute air pressure, $P_{AL}$ is the absolute pressure at the time of entry to the stopped position condition.

$AF_{WL}$ is the air-fuel ratio used to calculate $QF_{WL}$, $AF_W$ is the stored air-fuel ratio to be used at wide-open throttle, $T_{AL}$ is the air temperature used to calculate $QF_{WL}$, $T_A$ is the air temperature of the air being taken into the engine during the current (wide-open throttle) condition.

$QF_{WL}$ is calculated as:

$$QF_{WL} = \frac{QA_{WL}}{AF_{WL}}$$

where $QA_{WL}$ is the quantity of air predicted at the time that the throttle is stopped and is an estimate of the wide-open throttle airflow, and the ratio:

$$\frac{QA_{WL}}{AF_{WL}} = \frac{\frac{P_A}{P_{mp}} \times QA_P}{AF_{WL}} = \frac{P_A}{P_{mp}} \times \frac{AF_P}{AF_{WL}} \times QF_P,$$

where $P_{mp}$ is the manifold pressure $$AF_P \text{ is } \frac{QA_P}{QF_P},$$

where $QF_P$ is a prescribed fuel-limiting value proportional to engine speed N.

5. Apparatus for maintaining maximum power at wide-open throttle in a fuel injection type of internal combustion engine having a computer receiving input from (1) an accelerator pedal, (2) a pressure-drop sensor across the air-intake throttle, and (3) an engine-speed sensor, said computer producing output controlling a throttle actuator that controls the position of the throttle and also controlling a valve that controls the instantaneous amount of fuel being injected, comprising in combination therewith;

delaying means in said computer for responding to pedal movement that would cause said throttle to move to its wide-open position by causing the throttle actuator to stop said throttle just short of said wide-open position at a delay position where said pressure-drop sensor accurately senses a pressure drop closely related to actual airflow;

calculating means in said computer for calculating the airflow and optimum fuel-air ratio corresponding to said stopped-short position and then, employing stored data relating to the relationship between said stopped-short position and said wide-open position, calculating the airflow and optimum fuel-air ratio which should obtain at said wide open position; and advancing means triggered by the completion of those calculations for causing said throttle actuator to advance said throttle to its wide-open position while adjusting the fuel flow rate to match the airflow rate for precise air-fuel ratio control.

6. Apparatus for maintaining maximum power at wide-open throttle in a fuel injection type of internal combustion engine, comprising, an accelerator pedal, an air-intake throttle, a pressure-drop sensor across said throttle, an engine speed sensor, a computer having data storage means and receiving input from (1) said accelerator pedal, (2) said pressure-drop sensor, and (3) said engine-speed sensor, said computer producing output, a throttle actuator controlled by said computer output and itself controlling the position of said throttle, an injection valve controlled by said computer output and itself controlling the instantaneous amount of fuel being injected, said computer also having delaying means for responding to the movement of said accelerator pedal causing said throttle actuator to move said throttle to its wide-open position and for thereupon causing said throttle actuator to stop said throttle momentarily just short of said wide-open position at a delay position where said pressure-drop sensor accurately senses a pressure drop closely related to actual airflow;

said computer also including calculating means for calculating the airflow and optimum fuel-air ratio corresponding to said delay position and then, employing stored data in said data storage means relating to the relationship between said delay position and said wide-open position, calculating the airflow and optimum fuel-air ratio which will obtain at said wide-open position; and advancing means triggered by the completion of those calculations for causing said throttle actuator to advance said throttle to its wide-open position while simultaneously adjusting the fuel-flow rate to match the airflow rate for precise air-fuel ratio control.

7. The apparatus of claim 6 also including an absolute pressure sensor sensing ambient air, an ambient air temperature sensor ahead of said throttle, said computer having input means for receiving the absolute pressure and air temperature as so sensed and employing them as data during operation of said calculation means.

8. A computer-controlled throttle for engines having an accelerator pedal, a pressure-drop sensor sensitive to pressure drop through said throttle, an engine-speed sensor, and a fuel injector, comprising:

said throttle, a computer that receives fuel command signals related to the position of the accelerator pedal, a pressure drop signal from said pressure drop sensor, and an engine-speed signal from said engine speed sensor, said computer having data storage means and calculating means, and output means for controlling throttle position and fuel injection, and delay means actuated by movement of said pedal to its wide-open throttle position for providing a momentary stop of the throttle short of wide-open at a position where pressure drop is accurately measured enabling calculation of what fuel flow would be optimum at full throttle, completion of the calculation causing movement of the throttle to wide-open and injection of fuel at the calculated rate.

* * * * *